US006440924B1

(12) United States Patent
Jeschke et al.

(10) Patent No.: US 6,440,924 B1
(45) Date of Patent: Aug. 27, 2002

(54) AQUEOUS MULTIPHASE DETERGENTS WITH IMMISCIBLE PHASES

(75) Inventors: Rainer Jeschke; Ryszard Katowicz, both of Duesseldorf; Georg Meine, Mettmann; Alexander Ditze, Duesseldorf, all of (DE); Marc Benoit, Versailles (FR)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/646,320

(22) PCT Filed: Mar. 9, 1999

(86) PCT No.: PCT/EP99/01507

§ 371 (c)(1),
(2), (4) Date: Feb. 5, 2001

(87) PCT Pub. No.: WO99/47635

PCT Pub. Date: Sep. 23, 1999

(30) Foreign Application Priority Data

Mar. 16, 1998 (DE) ..... 198 11 386
Dec. 23, 1998 (DE) ..... 198 59 774

(51) Int. Cl.[7] ..... C11D 3/44; C11D 3/06

(52) U.S. Cl. ..... 510/417; 510/119; 510/130; 510/242; 510/421; 510/426; 510/405; 510/427; 510/127; 510/128

(58) Field of Search ..... 510/119, 130, 510/242, 417, 421, 426, 405, 427, 127, 128

(56) References Cited

U.S. PATENT DOCUMENTS 4,107,067 A 8/1978 Murphy et al. ..... 252/135

FOREIGN PATENT DOCUMENTS

| | | | |
|---|---|---|---|
| DE | 1 816 927 | | 7/1969 |
| EP | 116422 | * | 8/1984 |
| EP | 0 116 422 | | 8/1984 |
| EP | 0 175 485 | | 3/1986 |
| EP | 175485 | * | 3/1986 |
| EP | 0 522 506 | | 1/1993 |
| GB | 1 247 189 | | 9/1971 |
| GB | 1247189 | * | 9/1971 |
| JP | 61/296099 | | 12/1986 |

OTHER PUBLICATIONS

XP–002123618, Chemical Abstracts, 107 (4):25178e (1987).
Seifen–Oele–Fette–Wachse 112 (10):371–72 (1986).

* cited by examiner

*Primary Examiner*—Charles Boyer
(74) *Attorney, Agent, or Firm*—Stephen D. Harper; Glenn E. J. Murphy

(57) ABSTRACT

Aqueous, liquid, multiphase, surfactant-containing cleaning composition having at least two continuous phases, having at least one lower aqueous phase I and an upper aqueous phase II immiscible with the lower phase I and which can be temporarily converted into an emulsion by shaking, wherein the composition contains one or more hydrophobic components and up to about 5% by weight of sodium hexametaphosphate. The compositions are useful as hard surface cleaners.

80 Claims, No Drawings

AQUEOUS MULTIPHASE DETERGENTS WITH IMMISCIBLE PHASES

BACKGROUND OF THE INVENTION

This invention relates to aqueous, multiphase, liquid surfactant-containing cleaning compositions, which can be temporarily emulsified by shaking and which may be used for cleaning hard surfaces, and to a process for their production.

Universal cleaner for hard, wet-or damp-wipe surfaces in the domestic and institutional sectors are known as so-called multipurpose cleaners and are predominantly neutral to mildly alkaline, aqueous liquid products which contain 1 to 30% by weight of surfactants, 0 to 5% by weight of builders (for example citrates, gluconates, soda, polycarboxylates), 0 to 10% by weight of hydrotropes (for example alcohols, urea), 0 to 10% by weight of water-soluble solvents (for example alcohols, glycol ethers) and optionally inter alia skin-care ingredients, dyes and perfumes. Multipurpose cleaners are generally used in the form of a ca. 1% solution in water and, for local stain removal, may even be used in undiluted form. In addition, ready-to-use multipurpose cleaners are commercially available as so-called spray cleaners.

Aqueous liquid cleaners of the type in question are normally present as homogeneous stable solutions or dispersions. However, the effect of using certain, more especially hydrophobic, components in such cleaning compositions can be that this homogeneity is lost and inhomogoneous compositions with little chance of acceptance by the consumer are obtained. In cases such as these, there is a need for the alternative formulation of compositions which, despite their inhomogenelty, have a defined external appearance and form of use acceptable to the consumer.

European patent application 116 422 describes a liquid hair or body shampoo with two aqueous phases which can be temporarily dispersed in one another by shaking, the two phases being miscible with water in any ratio. The upper phase contains 8 to 25% by weight, based on the composition as a whole, of at least one surfactant while the lower phase contains at least 6% by weight, based on the composition as a whole, of dissolved sodium hexametaphosphate corresponding to formula I:

(I)

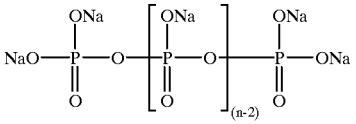

in which n stands for an average value of about 12. Other builder salts may optionally be present in the lower phase. Anionic, cationic, amphoteric and/or nonionic surfactants may be present as surfactants, at least one anionic surfactant preferably being present.

The problem addressed by the present invention was to provide high-performance storage-stable compositions for cleaning hard surfaces in a defined inhomogeneous, easy-to-handle and consumer-acceptable form.

DESCRIPTION OF THE INVENTION

In a first embodiment, the present invention relates to an aqueous, liquid, multiphase, surfactant-containing cleaning composition with at least two continuous phases which comprises at least one lower aqueous phase I and an upper aqueous phase II immiscible with the lower phase I and which can be temporarily converted into an emulsion by shaking, characterized in that it contains 0 to 5% by weight of sodium hexameta-phosphate.

Sodium hexametaphosphate in the context of the present invention is a mixture of condensed orthophosphates corresponding to formula I, in which n stands for an average value of about 12.

In the most simple case, a composition according to the invention consists of a lower continuous phase, which consists of the entire phase I, and of an upper continuous phase which consists of the entire phase II. However, one or more continuous phases of a composition according to the invention may also contain parts of another phase in emulsified form so that, in a composition such as this, phase I for example is partly present as continuous phase I, which represents the lower continuous phase of the composition, and is partly emulsified as discontinuous phase I in the upper continuous phase II. The same applies to phase II and other continuous phases.

In the context of the present invention, temporary means that 90% of the separation of the emulsion formed by shaking into the separate phases takes place over a period of 2 minutes to 10 hours at temperatures of about 20° C. to about 40° C., the remaining 2% of the separation into the phase state before shaking taking place over another 15 minutes to 50 hours.

In a second embodiment, the present invention relates to the use of an aqueous, liquid, multiphase surfactant-containing cleaning composition with at least two continuous phases, which comprises at least one lower aqueous phase I and an upper aqueous phase II immiscible with the lower phase I and which can be temporarily converted into an emulsion by shaking, for cleaning hard surfaces. Insofar as the following observations relate to the compositions according to the invention, they apply equally to the compositions of the use according to the invention.

The compositions according to the invention are distinguished by an unusually high cleaning performance against persistent fatty soil when used in undiluted form. In addition, the compositions show favorable residue behavior. The individual phases in the composition remain stable for long periods without forming deposits, for example, and the conversion into a temporary emulsion remains reversible even after frequent shaking. In addition, the separation of ingredients Into separate phases can promote the chemical stability of the composition.

The present invention also relates to a process for the production of a composition according to the invention by mixing directly from its raw materials, subsequent further mixing and, finally, leaving the composition to stand in order to separate the temporary emulsion.

In one preferred embodiment of the invention, continuous phases I and II are separated from one another by a clearly defined phase boundary.

In another preferred embodiment of the invention, one or both of the continuous phases I and II contain(s) parts, preferably 0.1 to 25% by volume and more preferably 0.2 to 15% by volume, based on the volume of the particular continuous phase, of the other phase as dispersant. In this embodiment, the continuous phase I or II is reduced by that part by volume which is distributed as dispersant in the other phase. Particularly preferred compositions are those in which phase I is emulsified into phase II in quantities of 0.1 to 25% by volume and preferably in quantities of 0.2 to 15% by volume, based on the volume of phase II.

In another preferred embodiment of the invention, part of the two phases—In addition to the continuous phases I and II—is present as an emulsion of one of the two phases in the other phase, this emulsion being separated from those parts of phases I and II which are not involved in the emulsion by two clearly defined phase boundaries, namely an upper and a lower phase boundary.

The compositions according to the invention contain phase I and phase II in a ratio by volume of 90:10 to 10:90, preferably 75:25 to 25:75 and more preferably 65:35 to 35:65.

In one particularly advantageous embodiment of the invention, the compositions contain one or more hydrophobic components. Suitable hydrophobic components are, for example, dialkyl ethers containing the same or different $C_{4-14}$ alkyl groups, more particularly dioctyl ethers; hydrocarbons with a boiling range of 100 to 300° C. and more particularly 140 to 280° C., for example aliphatic hydrocarbons with a boiling range of 145 to 200° C., isoparaffins with a boiling range of 200 to 260° C.; essential oils, more particularly limonene, and the pine oil extracted from pine roots and stumps; and also mixtures of these hydrophobic components, more especially mixtures of 2 or 3 of the hydrophobic components mentioned. Preferred mixtures of hydrophobic components are mixtures of different dialkyl ethers, of dialkyl ethers and hydrocarbons, of dialkyl ethers and essential oils, of hydrocarbons and essential oils, of dialkyl ethers and hydrocarbons and essential oils and of these mixtures. The compositions contain hydrophobic components in quantities, based on the composition, of 0 to 20% by weight, preferably 0.1 to 14% by weight, more preferably 0.5 to 10% by weight and most preferably 0.8 to 7% by weight.

The compositions according to the invention may contain phase separation auxiliaries. Suitable phase separation auxiliaries are, for example, alkali metal and alkaline earth metal chlorides and sulfates, more especially sodium and potassium chloride and sulfate, and ammonium chloride and sulfate and mixtures thereof. The salts mentioned, as strong electrolytes, assist phase, separation through the salt effect. Builder salts as electrolytes also produce this effect and, accordingly, are also suitable as phase separation aiuxiliaries. The compositions contain phase separation auxiliaries in quantities, based on the composition, of 0 to 30% by weight, preferably 1 to 20% by weight, more preferably 3 to 15% by weight and most preferably 5 to 12% by weight.

The compositions according to the Invention may contain anionic, nonionic, amphoteric or cationic surfactants or surfactant mixtures of one, several or all of these surfactant classes as their surfactant component. The compositions contain surfactants in quantities, based on the composition, of 0.01 to 30% by weight, preferably 0.1 to 20% by weight, more preferably 1 to 14% by weight and most preferably 3 to 10% by weight.

Suitable nonionic surfactants are, for example, $C_{8-18}$ alkyl alcohol polyglycol ethers, alkyl piolyglycosides and nitrogen-containing surtactants and mixtures thereof, more especially mixtures of the first two. The compositions contain nonionic surfactants in quantities, based on the composition, of 0 to 30% by weight, preferably 0.1 to 20% by weight, more preferably 0.5 to 14% by weight and most preferably 1 to 10% by weight.

$C_{8-18}$ alkyl alcohol polypropylene glycol/polyethylene glycol ethers are preferred known nor,ionic surfactants. They may be described by formula II, $R^1O—(CH_2CH(CH_3)O)_p(CH_2CH_2O)_e—H$, in which $R^1$ is a linear or branched, aliphatic alkyl and/or alkenyl group containing 8 to 18 carbon atoms, p is a 0 or a number of 1 to 3 and e is a number of 1 to 20.

The $C_{8-18}$ alkyl alcohol polyglycol ethers corresponding to formula II may be obtained by addition of propylene oxide and/or ethylene oxide onto alkyl alcohols, preferably onto fatty alcohols. Typical examples are polyglycol ethers corresponding to formula II, in which $R^1$ is an alkyl group containing 8 to 18 carbon atoms, p=0 to 2 and e is a number of 2 to 7. Preferred representatives are, for example $C_{10-14}$ fatty alcohol+PO+6EO ether (p=1, e=6) and $C_{12-18}$ fatty alcohol+7EO ether (p=0, e=7) and mixtures thereof. End-capped $C_{8-18}$ alkyl alcohol polyglycol ethers, i.e. compounds in which the free OH group in formula II is etherified, may also be used. The end-capped $C_{8-18}$ alkyl alcohol polyglycol ethers may be obtained by relevant methods of preparative organic chemistry. Preferably, $C_{8-18}$ alkyl alcohol polyglycol ethers are reacted with alkyl halides, more especially butyl or benzyl chloride, in the presence of bases. Typical examples are mixed ethers corresponding to formula II, in which $R^1$ is a technical fatty alcohol moiety, preferably a $C_{12/14}$ cocoalkyl moiety, p=0 and e=5 to 10, which are end-capped with a butyl group.

Other preferred nonionic surfactants are alkyl polyglycosides (APGs) corresponding to formula III, $R^2O[G]_x$, in which $R^2$ is a linear or branched, saturated or unsaturated alkyl group containing 8 to 22 carbon atoms, [G] is a glycosidic sugar unit and x is a number of 1 to 10. APGs are nonionic surfactants and are known materials which may be obtained by the relevant methods of preparative organic chemistry. The index x in goneral formula III indicates the degree of oligomerzation (DP degree), i.e. the distribution of mono-and oligoglycosides, and is a number of 1 to 10. Whereas x in a given compound must always be an integer and, above all, may assume a value of 1 to 6, the value x for a certain alkyl glycoside is an analytically determined calculated quantity which is generally a broken number. Alkyl glycosides with an average degree of oligomerization x of 1.1 to 3.0 are preferably used. Alkyl glycosides with a degree of oligomerization of less than 1.7 and, more particularly, between 1.2 and 1.6 are preferred from the applicational point view. Xylose but especially glucose is preferably used as the glycosidic sugar. The alkyl or alkenyl group $R^2$ (formula III) may be derived from primary alcohols containing 8 to 18 and preferably 8 to 14 carbon atoms. Typical examples are caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. However, the alkyl or alkenyl group $R^2$ is preferably derived from lauryl alcohol, myristyl alcohol, cetyl alcohol, palmitoleyl alcohol, stearyl alcohol, isostearyl alcohol or oleyl alcohol. Elaidyl alcohol, petroselinyl alcohol, arachidyl alcohol, gadoleyl alcohol, behenyl alcohol, erucyl alcohol and technical mixtures thereof are also mentioned.

Other suitable nonionic surfactants are nitrogen-containing surfactants, for example fatty acid polyhydroxyamides, for example glucamides, and ethoxylates of alkyl amines, vicinal diols and/or carboxylic acid amides containing alkyl groups with 10 to 22 carbon atoms and preferably 12 to 18 carbon atoms. The degree of ethoxylation of these compounds is generally between 1 and 20 and preferably between 3 and 10. Ethanolamide derivatives of alkanoic acids containing 8 to 22 carbon atoms and preferably 12 to 16 carbon atoms are preferred. Particularly suitable compounds include lauric acid, myristic acid and palmitic acid monoethanolamides.

Suitable anionic surfactants are the preferred $C_{8-18}$ alkyl sulfates, $C_{8-18}$ alkyl ether sulfates, i.e. the sulfation products of alcohol ethers corresponding to formula II, and/or $C_{8-18}$ alkyl benzenesulfonates, but also $C_{8-18}$ alkane sulfonates $C_{8-18}$ α-olefin suffonates, sulfonated $C_{8-18}$ fatty acids, more especially dodecyl benzenesulfonate, $C_{8-22}$ carboxylic acid amide ether sulfates, sulfosuccinic acid mono- and di-$C_{1-12}$-alkyl esters, $C_{8-18}$ alkyl polyglycol ether carboxylates, $C_{8-18}$ N-acyl taurides, $C_{8-18}$ N-sarcosinates and $C_{8-18}$ alkyl isethionates and mixtures thereof. They are used in the form of their alkali metal and alkaline earth metal salts, more especially sodium, potassium and magnesium salts, their ammonium and mono-, di-, tri- or tetraalkyl ammonium salts and—in the case of the sulfonates—also in the form of their corresponding acid, for example dodecyl benzene sulfonic acid. The compositions contain anionic surfactants in quantities, based on the composition, of 0 to 30% by weight, preferably 0.1 to 20% by weight, more preferably 1 to 14% by weight and most preferably 2 to 10% by weight.

By virtue of their foam-suppressing properties, the compositions according to the inventor may also contain soaps, i.e. alkali metal or ammonium salts of saturated or unsaturated $C_{6-22}$ fatty acids. The soaps may be used in a quantity of up to 5% by weight and preferably in a quantity of 0.1 to 2% by weight.

Suitable amphoteric, surfactants are, for example, betaines corresponding to the formula $(R^3)(R^4)(R^5)N^+CH_2COO^-$, in which R3 is a $C_{8-25}$ and preferably $C_{10-21}$ alkyl group optionally interrupted by hetero atoms or hetero atom groups and $R^4$ and $R^5$ may be the same or different and represent alkyl groups containing 1 to 3 carbon atoms, more especially $C_{18-18}$ alkyl dimethyl carboxymethyl betaine and $C_{11-17}$ alkylamidopropyl dimethyl carboxymethyl betaine. The compositions contain amphoteric surfactants in quantities, based on the composition, of 0 to 15% by weight, preferably 0.01 to 10% by weight and more preferably 0.1 to 5% by weight.

Suitable cationic surfactants are inter alia quaternary ammonium compounds with the formula $(R^6)(R^7)(R^8)(R^9)N^{+X-}$, in which $R^6$ to $R^9$ stand for four identical or different, more especially two long-chain and two short-chain, alkyl groups and $X^-$ is an anion, more particularly a halide ion, for example didecyl dimethiyl ammonium chloride, alkyl benzyl didecyl ammonium chloride and mixtures thereof. The compositions contain cationic surfactants in quantities, based on the composition, of 0 to 10% by weight, preferably 0.01 to 5% by weight and more preferably 0.1 to 3% by weight.

In another preferred embodiment, the compositions according to the invention contain anionic and nonionic surfactants alongside one another, preferably $C_{8-18}$ alkyl benzenesulfonates, $C_{8-18}$ alkyl sulfates and/or $C_{8-18}$ alkyl ether sulfates alongside $C_{8-18}$ alkyl alcohol polyglycol ethers and/or alkyl polyglycosides, more especially $C_{8-18}$ alkyl benzenesulfonates alongside $C_{8-18}$ alkyl alcohol polyglycol ethers.

The compositions according to the invention may also contain builders. Suitable builders are, for example, alkali metal gluconates, citrates, nitrilotriacetates, carbonates and bicarbonates, more especially sodium gluconate, citrate and nitrilotriacetate and sodium and potassium carbonate and bicarbonate, and alkali metal and alkaline earth metal hydroxides, more especially sodium and potassium hydroxide, ammonia and amines, more especially mono and triethanolamine, and mixtures thereof. Other suitable builders are the salts of glutaric acid, succinic acid, adipic acid, tartaric acid and benzenehexacarboxylic acid and also phosphonates and phosphates. The compositions contain builders in quantities, based on the composition, of 0 to 20% by weight, preferably 0.01 to 12% by weight, more preferably 0.1 to 8% by weight and most preferably 0.3 to 5% by weight, although the quantity of sodium hexametaphosphate—except for the compositions of the use according to the invention—is limited to 0 to 5% by weight. As electrolytes, the builder salts also act as phase separation auxiliaries.

Besides the components mentioned, the compositions according to the invention may contain other auxiliaries and additives which are normally present in such compositions. These include, in particular, polymers, soil release agents, solvents (for example ethanol, isopropanol, glycol ethers), solubilizers, hydrotropes (for example cumene sulfonate, octyl sulfate, butyl glucoside, butyl glycol), cleaning boosters, viscosity regulators (for example synthetic polymers, such as polysaccharides, polyacrylates, naturally occurring polymers and derivatives thereof, such as xanthan gum, other polysaccharides and/or gelatin), pH regulators (for example citric acid, alkanolamines or NaOH), disinfectants, antistatic agents, preservatives, bleaching systems, enzymes, perfume, dyes and fragrances and also opacifiers or even the skin-care Ingredients described in EP-A-522 556. The quantity in which such additives are present in the cleaning composition is normally not more than 12% by weight. The lower limit to the quantity used depends upon the nature of the additive and, in the case of dyes for example, can be 0.001% by weight or lower. The quantity of auxiliaries is preferably between 0.01 and 7% by weight and more preferably between 0.1 and 4% by weight.

The pH value of the compositions according to the invention may be varied over a wide range, although a pH in the range from 2.5 to 12 is preferred and a pH in the range from 5 to 10.5 particularly preferred. In the context of the present invention, the pH value of the compositions according to the invention is understood to be the pH value of the composition in the form of the temporary emulsion.

The compositions according to the invention may be prepared by mixing directly from their raw materials, subsequent further mixing and, finally, leaving the composition to stand in order to separate the temporary emulsion.

EXAMPLES

Compositions E1 to E7 according to the invention were prepared as described above. Their compositions in % by weight and their pH value are shown in Table 1. The compositions show two continuous phases, the upper phase being slightly clouded and temporarily forming a creamy-looking emulsion on shaking. The following components were used:

a) dodecyl benzenesulfonic acid,
b) $C_{10-14}$ fatty alcohol+1PO+1EO ether,
c) $C_{12-18}$ fatty alcohol+7EO ether,
d) monoethanolamine,
e) sodium hydroxide,
f) sodium chloride,
g) sodium gluconate,
h) aliphatic hydrocarbon (boiling range 145 to 200° C.),
i) isoparaffins (boiling range: 200 to 260° C.),
j) dioctyl ether, k) perfume and l) water.

Compositions E1 to E7 additionally contained small quantities of dye.

TABLE 1

| [% by weight] | E1 | E2 | E3 | E4 | E5 | E6 | E7 |
|---|---|---|---|---|---|---|---|
| a) | 4 | 4 | 4 | 5 | 4 | 4 | 4 |
| b) | — | 1 | — | 2 | 1 | — | — |
| c) | 2 | 2 | 2 | — | 2 | 2 | 2 |
| d) | 1 | 0.75 | 1 | 1 | 1 | 1 | — |
| e) | — | — | — | — | — | — | 0.5 |
| f) | 9 | 6.5 | 10 | 9 | 8 | 10 | 10 |
| g) | — | — | — | — | 2 | — | — |
| h) | — | 5 | — | — | — | 1 | — |
| i) | — | — | 5 | — | — | — | — |
| j) | 5 | — | — | 5 | 5 | 4 | 5 |
| k) | 1 | 1 | 1 | 1 | 1 | 1 | 1 |
| l) | to 100 | to 100 | to 100 | to 100 | to 100 | to 100 | to 100 |
| pH value | 9.3 | 8.6 | 9.3 | 9.3 | 9.5 | 9.3 | 9.5 |

Testing of Cleaning Performance

The cleaning performance of the cleaning compositions formulated in accordance with the invention was evaluated by the test described in Selfen-Öle-Fotte-Wachse 1986, 112, page 371, which gives highly repro-ducible results. In this test, the cleaning composition to be tested was applied to an artificially soiled white plastic surface. A mixture of soot, machine oil, triglyceride of saturated fatty acids and low-boiling aliphatic hydrocarbon was used as the artificial soil for the dilute application of the cleaning composition. The 26×28 cm test surface was uniformly coated with 2 g of the artificial soil using a surface coater.

A plastic sponge was impregnated with quantities of 10 ml of the cleaning solution to be tested and mechanically moved over the test surface which had also been coated with 10 ml of the cleaning composition to be tested. After 10 wiping movements, the cleaned test surface was held under running water and the loose soil thus removed. The cleaning effect, i.e. the whiteness of the so-called plastic surface, was measured with a Dr. Lange "Microcolor"—an Instrument for measuring color difference. The clean untreated white plastic surface served as the whiteness standard.

The test was carried out with cleaning composition E1 according to the invention in diluted form (concentration 6 $ml \cdot l^{-1}$) and in undiluted form. For comparison, the test was carded out with a leading German multipurpose cleaner containing more than 10% by weight of surfactants (C1) both in diluted form (concentration 6 $ml \cdot l^{-1}$) and in undiluted form.

Cleaning composition E1 according to the invention outperforms cleaner C1 with its far higher surfactant content both in diluted form and in undiluted form.

Testing of Residue Behavior

Residue behavior was tested on black tiles. The residue score of the compositions according to the invention is at the level of multipurpose cleaners commercially available in Germany. This is still the case when the compositions contain hydrophobic components.

Composition of Phases I and II

The composition of phases I and II of cleaner E1 according to the invention is shown in Table 2.

TABLE 2

| E1 | Phase I [% by weight] | Phase II [% by weight] |
|---|---|---|
| a) | 0 | 6.2 |
| c) | <0.05 | 3.3 |
| d) | 1.06 | 1.0 |
| f) | 11.5 | 8.9 |
| j) | <0.05 | 7.9 |
| k) | <0.05 | 1.6 |
| l) | 85.0 | 70.7 |

The upper phase II contains almost the entire quantity of surfactant (a, c), hydrophobic component (j) and perfume (k) while the lower phase I almost exclusively contains part of the phase separation auxiliary (f) and the builder (d).

What is claimed is:

1. An aqueous, liquid, multiphase, surfactant-containing cleaning composition having at least two continuous phases, which comprises at least one lower aqueous phase I and an upper aqueous phase II immiscible with the lower phase I and which can be temporarily converted into an emulsion by shaking, wherein the composition comprises one or more hydrophobic components and more than 0% up to about 5% by weight of sodium hexametaphosphate.

2. The composition of claim 1, wherein the continuous phases I and II are separated from one another by a clearly defined phase boundary.

3. The composition of claim 1, wherein one or both of the continuous phases I and II comprise 0.1% to 25% by volume, based on the volume of the particular continuous phase, of the other phase as dispersant.

4. The composition of claim 3, wherein one or both of the continuous phases I and II comprise 0.2% to 15% by volume, based on the volume of the particular continuous phase, of the other phase as dispersant.

5. The composition of claim 1, wherein phase I is emulsified into phase II in quantities of 0.1% to 25% by volume, based on the volume of phase II.

6. The composition of claim 5, wherein phase I is emulsified into phase II in quantities of 0.2% to 15% by volume, based on the volume of phase II.

7. The composition of claim 1, wherein part of each of the two continuous phases I and II is present as an emulsion of one of the two phases in the other phase, this emulsion being separated from those parts of phases I and II which are not involved in the emulsion by two clearly defined phase boundaries.

8. The composition of claim 1, comprising phase I and phase II in a ratio by volume of 90:10 to 10:90.

9. The composition of claim 8, comprising phase I and phase II in a ratio by volume of 75:25 to 25:75.

10. The composition of claim 9, comprising phase I and phase II in a ratio by volume of 65:35 to 35:65.

11. The composition of claim 1, wherein the hydrophobic component or components comprise one or more selected from the group consisting of dialkyl ethers containing identical or different $C_{4-14}$ alkyl groups, hydrocarbons with a boiling range of 100 to 300° C., essential oils, and mixtures thereof.

12. The composition of claim 11, wherein the hydrophobic component or components comprise one or more selected from the group consisting of dioctyl ethers, hydrocarbons with a boiling range of 140 to 280° C., limonene, pine oil, and mixtures thereof.

13. The composition of claim 1, further comprising one or more phase separation auxiliaries.

14. The composition of claim 13, wherein the phase separation auxiliary or auxiliaries are selected from the group consisting of alkali metal and alkaline earth metal chlorides and sulfates.

15. The composition of claim 13, wherein the phase separation auxiliary or auxiliaries are selected from the group consisting of sodium chloride, sodium sulfate, potassium chloride, potassium sulfate, ammonium chloride, ammonium sulfate, and mixtures thereof.

16. The composition of claim 1, further comprising one or more anionic surfactants.

17. The composition of claim 16, wherein the anionic surfactant or surfactants are selected from the group consisting of $C_{8-18}$ alkyl sulfates, $C_{8-18}$ alkyl ether sulfates, $C_{8-18}$ alkyl benzenesulfonates, and mixtures thereof.

18. The composition of claim 1, further comprising one or more nonionic surfactants.

19. The composition of claim 18, wherein the nonionic surfactant or surfactants are selected from the group consisting of $C_{8-18}$ alkyl alcohol polyglycol ethers, alkyl polyglycosides, and mixtures thereof.

20. The composition of claim 1, further comprising one or more anionic and one or more nonionic surfactants.

21. The composition of claim 20, wherein the anionic surfactant or surfactants are selected from the group consisting of $C_{8-18}$ alkyl benzenesulfonates, $C_{8-18}$ alkyl sulfates, and $C_{8-18}$ alkyl ether sulfates and the nonionic surfactant or surfactants are selected from the group consisting of $C_{8-18}$ alkyl alcohol polyglycol ethers and alkyl polyglycosides.

22. The composition of claim 20, comprising $C_{8-18}$ alkyl benzenesulfonates alongside $C_{8-18}$ alkyl alcohol polyglycol ethers.

23. The composition of claim 1, further comprising one or more cationic surfactants.

24. The composition of claim 1, further comprising one or more builders.

25. The composition of claim 24, comprising one or more builders selected from the group consisting of alkali metal gluconates, alkali metal citrates, alkali metal nitrilotriacetates, alkali metal carbonates, alkali metal bicarbonates, alkali metal hydroxides, alkaline earth metal hydroxides, ammonia, amines, and mixtures thereof.

26. The composition of claim 25, further comprising one or more builders selected from the group consisting of monoethanolamine, triethanolamine, and mixtures thereof.

27. A method of cleaning a hard surface comprising shaking the composition of claim 1, to form a temporary emulsion, and applying a cleaning-effective amount of said composition to the hard surface.

28. An aqueous, liquid, multiphase, surfactant-containing cleaning composition having at least two continuous phases, which comprises at least one lower aqueous phase I and an upper aqueous phase II immiscible with the lower phase I and which can be temporarily converted into an emulsion by shaking, wherein the composition comprises 0.1% to 20% by weight of one or more hydrophobic dialkyl ethers containing identical or different $C_{4-14}$ alkyl groups.

29. The composition of claim 28, wherein the continuous phases I and II are separated from one another by a clearly defined phase boundary.

30. The composition of claim 28, wherein one or both of the continuous phases I and II comprise 0.1% to 25% by volume, based on the volume of the particular continuous phase, of the other phase as dispersant.

31. The composition of claim 30, wherein one or both of the continuous phases I and II comprise 0.2% to 15% by volume, based on the volume of the particular continuous phase, of the other phase as dispersant.

32. The composition of claim 28, wherein phase I is emulsified into phase II in quantities of 0.1% to 25% by volume, based on the volume of phase II.

33. The composition of claim 32, wherein phase I is emulsified into phase II in quantities of 0.2% to 15% by volume, based on the volume of phase II.

34. The composition of claim 28, wherein part of each of the two continuous phases I and II is present as an emulsion of one of the two phases in the other phase, this emulsion being separated from those parts of phases I and II which are not involved in the emulsion by two clearly defined phase boundaries.

35. The composition of claim 34, comprising phase I and phase II in a ratio by volume of 90:10 to 10:90.

36. The composition of claim 35, comprising phase I and phase II in a ratio by volume of 75:25 to 25:75.

37. The composition of claim 36, comprising phase I and phase II in a ratio by volume of 65:35 to 35:65.

38. The composition of claim 28, wherein the hydrophobic dialkyl ethers comprise one or more dioctyl ethers.

39. The composition of claim 28, further comprising one or more phase separation auxiliaries.

40. The composition of claim 39, wherein the phase separation auxiliary or auxiliaries are selected from the group consisting of alkali metal and alkaline earth metal chlorides and sulfates.

41. The composition of claim 39, wherein the phase separation auxiliary or auxiliaries are selected from the group consisting of sodium chloride, sodium sulfate, potassium chloride, potassium sulfate, ammonium chloride, ammonium sulfate, and mixtures thereof.

42. The composition of claim 28, further comprising one or more anionic surfactants.

43. The composition of claim 42, wherein the anionic surfactant or surfactants are selected from the group consisting of $C_{8-18}$ alkyl sulfates, $C_{8-18}$ alkyl ether sulfates, $C_{8-18}$ alkyl benzenesulfonates, and mixtures thereof.

44. The composition of claim 28, further comprising one or more nonionic surfactants.

45. The composition of claim 44, wherein the nonionic surfactant or surfactants are selected from the group consisting of $C_{8-18}$ alkyl alcohol polyglycol ethers, alkyl polyglycosides, and mixtures thereof.

46. The composition of claim 28, further comprising one or more anionic and one or more nonionic surfactants.

47. The composition of claim 46, wherein the anionic surfactant or surfactants are selected from the group consisting of $C_{8-18}$ alkyl benzenesulfonates, $C_{8-18}$ alkyl sulfates, and $C_{8-18}$ alkyl ether sulfates and the nonionic surfactant or surfactants are selected from the group consisting of $C_{8-18}$ alkyl alcohol polyglycol ethers and alkyl polyglycosides.

48. The composition of claim 46, comprising $C_{8-18}$ alkyl benzenesulfonates alongside $C_{8-18}$ alkyl alcohol polyglycol ethers.

49. The composition of claim 28, further comprising one or more cationic surfactants.

50. The composition of claim 28, further comprising one or more builders.

51. The composition of claim 50, comprising one or more builders selected from the group consisting of alkali metal gluconates, alkali metal citrates, alkali metal nitrilotriacetates, alkali metal carbonates, alkali metal bicarbonates, alkali metal hydroxides, alkaline earth metal hydroxides, ammonia, amines, and mixtures thereof.

52. The composition of claim 51, further comprising one or more builders selected from the group consisting of monoethanolamine, triethanolamine, and mixtures thereof.

53. A method of cleaning a hard surface comprising shaking an aqueous, liquid, multiphase, surfactant-containing cleaning composition having at least two continuous phases, which comprises at least one lower aqueous phase I and an upper aqueous phase II immiscible with the lower phase I and which can be temporarily converted into an emulsion by shaking, wherein the composition comprises one or more hydrophobic components, to form a temporary emulsion, and applying an cleaning-effective amount of said composition to the hard surface.

54. The method of claim 53, wherein the continuous phases I and II are separated from one another by a clearly defined phase boundary.

55. The method of claim 53, wherein one or both of the continuous phases I and II comprise 0.1% to 25% by volume, based on the volume of the particular continuous phase, of the other phase as dispersant.

56. The method of claim 55, wherein one or both of the continuous phases I and II comprise 0.2% to 15% by volume, based on the volume of the particular continuous phase, of the other phase as dispersant.

57. The method of claim 53, wherein phase I is emulsified into phase II in quantities of 0.1% to 25% by volume, based on the volume of phase II.

58. The method of claim 57, wherein phase I is emulsified into phase II in quantities of 0.2% to 15% by volume, based on the volume of phase II.

59. The method of claim 53, wherein part of each of the two continuous phases I and II is present as an emulsion of one of the two phases in the other phase, this emulsion being separated from those parts of phases I and II which are not involved in the emulsion by two clearly defined phase boundaries.

60. The method of claim 59, wherein the cleaning composition comprises phase I and phase II in a ratio by volume of 90:10 to 10:90.

61. The method of claim 60, wherein the cleaning composition comprises phase I and phase II in a ratio by volume of 75:25 to 25:75.

62. The method of claim 61, wherein the cleaning composition comprises phase I and phase II in a ratio by volume of 65:35 to 35:65.

63. The method of claim 62, wherein the hydrophobic component or components comprise one or more selected from the group consisting of dioctyl ethers, hydrocarbons with a boiling range of 140 to 280° C., limonene, pine oil, and mixtures thereof.

64. The method of claim 53, wherein the cleaning composition further comprises one or more phase separation auxiliaries.

65. The method of claim 64, wherein the phase separation auxiliary or auxiliaries are selected from the group consisting of alkali metal and alkaline earth metal chlorides and sulfates.

66. The method of claim 64, wherein the phase separation auxiliary or auxiliaries are selected from the group consisting of sodium chloride, sodium sulfate, potassium chloride, potassium sulfate, ammonium chloride, ammonium sulfate, and mixtures thereof.

67. The method of claim 53, wherein the cleaning composition further comprises one or more anionic surfactants.

68. The method of claim 67, wherein the anionic surfactant or surfactants are selected from the group consisting of $C_{8-18}$ alkyl sulfates, $C_{8-18}$ alkyl ether sulfates, $C_{8-18}$ alkyl benzenesulfonates, and mixtures thereof.

69. The method of claim 53, wherein the cleaning composition further comprises one or more nonionic surfactants.

70. The method of claim 69, wherein the nonionic surfactant or surfactants are selected from the group consisting of $C_{8-18}$ alkyl alcohol polyglycol ethers, alkyl polyglycosides, and mixtures thereof.

71. The method of claim 53, wherein the cleaning composition further comprises one or more anionic and one or more nonionic surfactants.

72. The method of claim 71, wherein the anionic surfactant or surfactants are selected from the group consisting of $C_{8-18}$ alkyl benzenesulfonates, $C_{8-18}$ alkyl sulfates, and $C_{8-18}$ ether sulfates and the nonionic surfactant or surfactants are selected from the group consisting of $C_{8-18}$ alkyl alcohol polyglycol ethers and alkyl polyglycosides.

73. The method of claim 72, wherein the anionic surfactants comprise $C_{8-18}$ alkyl benzenesulfonates alongside $C_{8-18}$ alkyl alcohol polyglycol ethers.

74. The method of claim 53, wherein the cleaning composition further comprises one or more cationic surfactants.

75. The method of claim 53, wherein the cleaning composition further comprises one or more builders.

76. The method of claim 75, wherein the cleaning composition further comprises one or more builders selected from the group consisting of alkali metal gluconates, alkali metal citrates, alkali metal nitrilotriacetates, alkali metal carbonates, alkali metal bicarbonates, alkali metal hydroxides, alkaline earth metal hydroxides, ammonia, amines, and mixtures thereof.

77. The composition of claim 76, wherein the cleaning composition further comprises one or more builders selected from the group consisting of monoethanolamine, triethanolamine, and mixtures thereof.

78. The composition of claim 28, comprising 0.1% to 14% by weight of the one or more hydrophobic dialkyl ethers.

79. The composition of claim 78, comprising 0.5% to 10% by weight of the one or more hydrophobic dialkyl ethers.

80. The composition of claim 79, comprising 0.8% to 7% by weight of the one or more hydrophobic dialkyl ethers.

* * * * *

UNITED STATES PATENT AND TRADEMARK OFFICE

CERTIFICATE OF CORRECTION

PATENT NO. : 6,440,924 B1
DATED : August 27, 2002
INVENTOR(S) : Jeschke et al.

It is certified that error appears in the above-identified patent and that said Letters Patent is hereby corrected as shown below:

Column 12,
Line 24, before "ether", insert -- alkyl --.

Signed and Sealed this

Ninth Day of September, 2003

JAMES E. ROGAN
*Director of the United States Patent and Trademark Office*